United States Patent [19]

Dahlberg et al.

[11] Patent Number: 4,795,265

[45] Date of Patent: Jan. 3, 1989

[54] METHOD AND DEVICE FOR INTIMATE MIXING OF TWO COMPONENTS IN A PACKAGE

[75] Inventors: Anders Dahlberg; Leif Dahlberg, both of Täby, Sweden

[73] Assignee: Tatis Plasttatningar AB, Taby, Sweden

[21] Appl. No.: 940,814

[22] PCT Filed: Mar. 26, 1986

[86] PCT No.: PCT/SE86/00142

§ 371 Date: Nov. 24, 1986

§ 102(e) Date: Nov. 24, 1986

[87] PCT Pub. No.: WO86/05713

PCT Pub. Date: Oct. 9, 1986

[30] Foreign Application Priority Data

Mar. 29, 1985 [SE] Sweden ..... 8501583

[51] Int. Cl.[4] ..... B01F 3/10; B65D 81/32

[52] U.S. Cl. ..... 366/69; 206/219

[58] Field of Search ..... 366/69, 349; 206/219, 206/222, 368; 222/94

[56] References Cited

U.S. PATENT DOCUMENTS

| | | | |
|---|---|---|---|
| 3,028,000 | 4/1962 | Clements et al. | 206/219 |
| 3,771,773 | 11/1973 | Schriever | 366/349 X |
| 4,226,330 | 10/1980 | Butler | 206/219 X |
| 4,280,391 | 7/1981 | Fischer et al. | 206/219 X |
| 4,509,642 | 4/1985 | Rowell | 206/219 |

FOREIGN PATENT DOCUMENTS 7909418 7/1981 Sweden .

*Primary Examiner*—Stuart S. Levy
*Assistant Examiner*—Lynn M. Sohacki
*Attorney, Agent, or Firm*—Pollock, Vande Sande & Priddy

[57] ABSTRACT

A method and a device for intimately mixing two or more liquid or paste-like components inside a flexible plastic package (2). A squeezing roller (3) causes the components to be fed forward step by step between different compartments in the package, whereupon the discharge from one compartment to the next occurs suddenly and explosively, so that intimate and effective mixing of the components (A,B) is achieved.

13 Claims, 6 Drawing Sheets

P
A(16)
B(17)
1
2
3
4
5
6
7
8a
8b
9a
9b
10
11
12
13
14
15
18
19
20a
20b
20c
20d
21
22a
22b
22c
23
2a
2b

METHOD AND DEVICE FOR INTIMATE MIXING OF TWO COMPONENTS IN A PACKAGE

FIELD OF THE INVENTION

The invention relates to a method and a device for intimately mixing at least two hardly mixable components with each other wherein, initially, the different components are kept in separate storage compartments in a flexible package, whereupon an external pressure is applied to the package to cause the components to flow into a common compartment while being mixed together.

BACKGROUND OF THE INVENTION

A device of this kind is known from US-A-3 028 000, namely, in the form of a plastic foil package with two chambers arranged in parallel adjacent to each other and being separated by an easily detachable sealing line. The sealing line is disposed in such a way that it will break along predetermined parts when external pressure is applied by manual kneading. By kneading repeatedly, two different liquids, initialy kept in separate chambers, are mixed together and are discharged upon tearing off a lap.

For mutually easily soluble liquids of low viscosity, such an arrangement work well, but problems arise when trying to mix hardly soluble liquids or paste-like components in this way, in particular when they differ in respect of viscosity and density.

SUMMARY OF THE INVENTION

Thus, the object of the invention is to achieve a method and a device securing effective mixing action, even in the case of mutually barely mixable substances, especially substances which for health or individual hygienic reasons are to be kept and handled in closed vessels or tube systems. An example of such components are industrially useable epoxy plastic systems with a resin and a hardening agent, e.g., intended for injection or serving as glue or putty. Then, extremely vigorous stirring or other mechanical action is necessary to ensure that the components are properly mixed so as to engage in a chemical reaction.

In using a method of the kind mentioned initially, this object is achieved in that, according to the invention, in a first step, the different components are transferred into a common compartment and, in a second step, by applying external pressure and building up increased internal pressure in the common compartment, the components are brought to flow explosively into an adjacent compartment while being intimately mixed with each other.

Thus, in practice, it has turned out that a sudden, explosive flow of the components into an adjoining compartment results in remarkably effective mixing action, whereby the components will form a homogeneous mass, in particular if the operation is repeated a number of times.

The demarcation between the adjoining compartments or chambers may be quickly eliminated in different ways, e.g., in that a partition or seal is caused to break by applying increased pressure adapted to cause the desired explosive flow or that a blocking element, which exerts a squeezing force on the flexible package, is suddenly emoved. In the latter case, the package has no pre-fabricated demarcations, but these are formed by the influence of the blocking element.

It is also possible to press the components forward, by a squeezing action, against a transverse partition having separate flow passages, so that the flow velocity increases dramatically in the final stage when the squeezing force approaches the transverse partition.

BRIEF DESCRIPTION OF THE DRAWINGS

In order that the invention may be more clearly understood, reference will now be made to the accompanying drawings, wherein several embodiments of the invention are shown for purposes of illustration, and wherein.

DESCRIPTION OF PREFERRED EMBODIMENTS

Figures 1, 2A, 2B, 3:
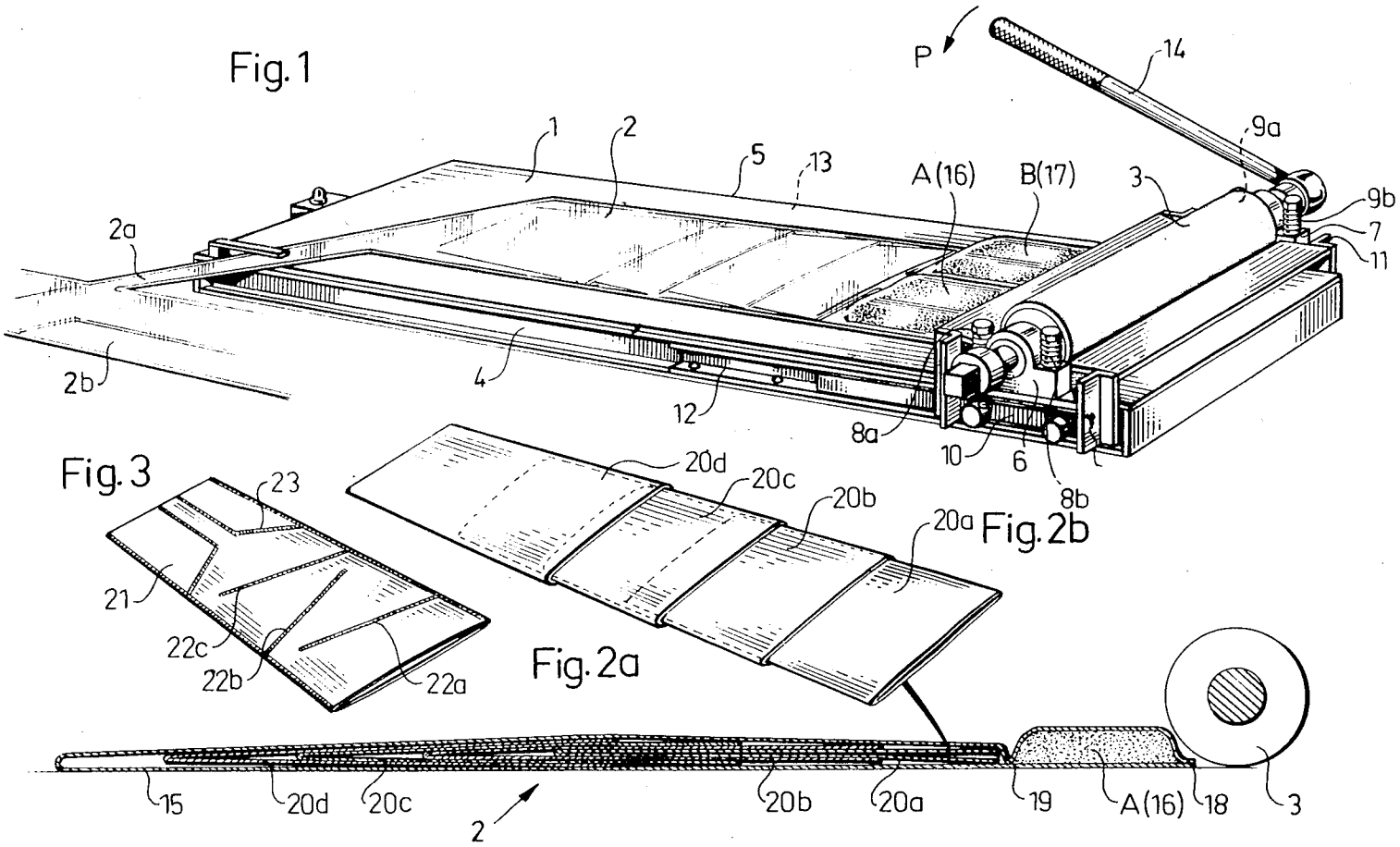
FIG. 1 is a perspective view of a first embodiment of an inventive package placed on a plate with a squeezing roller.
FIG. 2*a* shows the arrangement according to FIG. 1 in longitudinal section.
FIG. 2*b* shows in a perspective view a number of interlapping foil pockets included in the package according to FIGS. 1 and 2*a;*
FIG. 3 shows an auxiliary discharge device which may be included in the package according to FIGS. 1 and 2*a;*

The arrangement shown in FIG. 1 comprises an elongated rectangular plate 1 and a package 2 according to the invention laid thereon, said package consisting of a flexible, flat container made of thermoplastic foil and containing two mutually barely miscible, liquid or paste-like components A and B, which are to be mixed intimately with each other inside the container. For this purpose, a squeezing roller 3 is arranged for rolling over the plate 1 and the container 2 while being guided along the longitudinal edges 4 and 5 of the plate 1. The roller 3 is journalled at its ends in bearing members 6 and 7, which by means of pressure springs 8*a*, 8*b* and 9*a*, 9*b*, respectively, are pressed down resiliently against a holding member 10 and 11, respectively, being displaceable in the longitudinal direction in U-shaped guide rails 12 and 13, respectively. By means of a handle 14, which is operative in the direction of the arrow P but is idle in the opposite direction, the roller 3 can be brought to roll over the flat package 2 on the plate 1 while contacting the same resiliently. In a manner to be described more fully below, the components A and B will be intimately mixed with each other and eventually discharged via a discharge channel 2*a*, which is unitary with the package 2 and communicates with a tubular pipe-sealing element 2*b*, e.g., of the kind described in SE-B-7909418-1, for sealing an annular space between a pipe and a surrounding connector sleeve. In this case the components A and B are constituted by a resin and a hardening agent, respectively, which are to be injected into the sealing element 2*b* so as to form, upon hardening, a permanent seal of said annular space.

In FIG. 2*a* the package 2 is shown in longitudinal section, illustrating that the package 2 consists of an external container 15 having at one end (adjacent to the roller 3 in FIG. 2*a*) storage compartments 16 and 17 for the components A and B, respectively. Each storage compartment 16 and 17, respectively, is delimited at its outer end by a strong weld-joint 18 and at the other end by a weaker weld-joint 19. The latter is designed to break under the influence of the squeezing pressure exerted by the roller 3, whereas, however, the wall of container 15 is kept intact. Thus, the components A and B will flow into the left part of the container 15 in FIG. 2*a*. As shown in FIG. 2*b*, in this part a number of foil pockets 20*a*,20*b*,20*c*,20*d* are partly inserted into one another.

A discharge pocket (see FIG. 3) may be connected to the foil pockets 20*a* to 20*d* inside the container 2. The discharge pocket 21 is provided with somewhat oblique internal walls 22*a*, 22*b*, 22*c*, which delimit a meander-shaped discharge path, and a funnel-shaped discharge channel 23.

Figure 4A:
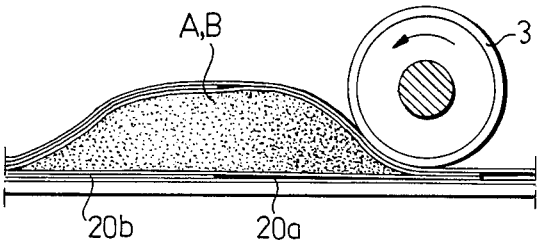
FIGS. 4*a* to 4*c* show a section of FIG. 2*a* in a larger scale to illustrate the different phases of the mixing of different components included in the package.
Figure 4B:
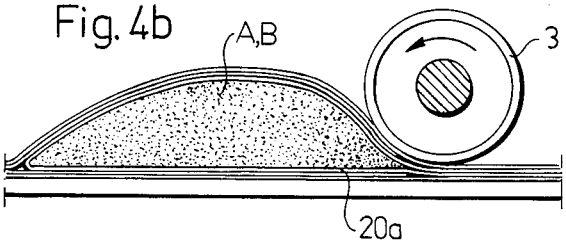
Figure 4C:
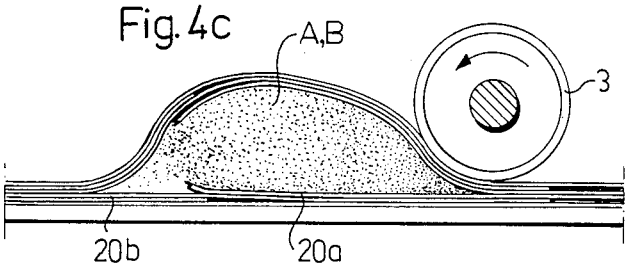

FIGS. 4*a* to 4*c* illustrate how the components A and B are fed through the package 2 while the roller 3 rolls along the plate 1. When the weld 19 in the compartments 16 and 17, respectively, has been broken, the components A and B are pressed into the first pocket 20*a*, as illustrated in FIG. 4*a*. Now, the pocket 20*a* is partly enclosed at its rear part by the succeeding pocket 20*b*. When the roller 3 has rolled a bit further, as shown in FIG. 4*b*, the volume is somewhat reduced within the pocket 20*a*, resulting in a strong overpressure inside the pocket 20*a*. Finally, the pocket 20*a* breaks due to the increased pressure, as illustrated in FIG. 4*c*. Then, in accordance with the invention, the components A,B will be discharged suddenly and explosively into the inside of the adjacent pocket 20*b*. In spite of the fact that the components A,B under normal conditions are not inclined to be mixed homogeneously with each other because of different viscosity and density, it has turned out that they will be mixed intimately with each other during the explosive discharge. When the roller 3 is brought to roll further over the package 2on the plate 1, the mixture of the components A and B will be successively transferred from one pocket to the other in a similar way, wherein each pocket 20*b*, 20*c*, 20*d* will break at its rear and, so that the component mixture is transferred step by step towards the discharge end. By the time that the mixture reaches the discharge channel 2*a*, the components are intimately mixed with each other and form a homogeneous compound.

Figure 5:
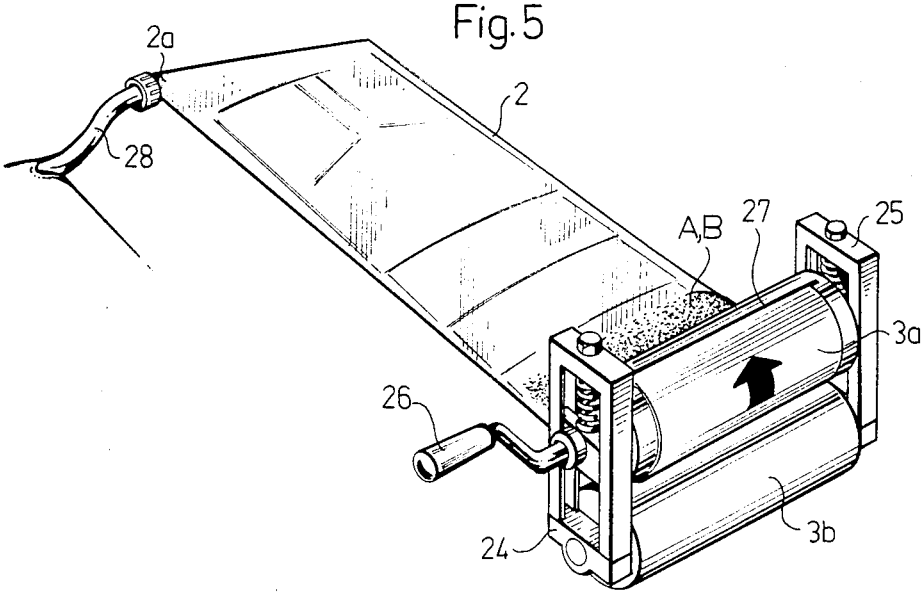
FIG. 5 is a perspective view of a simpler squeezing device.

FIG. 5 shows a simpler arrangement, wherein two rollers 3*a* and 3*b* are resiliently journalled for mutual contact in a frame provided with side pieces 24 and 25. By means of a crank 26, the rollers are rotated, so that the package 2, which in this case is loosely applied, progresses through the nip between the rollers 3*a* and 3*b* and is wound onto the upper roller 3*a*. In this case, the outer end of the package 2 is inserted into a slot 27 in the upper roll in the same way as in the case of a film roll. Otherwise, the procedure is the same as described above, wherein, consequently, the components A,B step by step flow explosively from one pocket to the succeeding one, inside the package 2. Finally, the mixture is discharged via a hose 28 connected to the discharge end 2*a* of the package 2.

Figure 6:
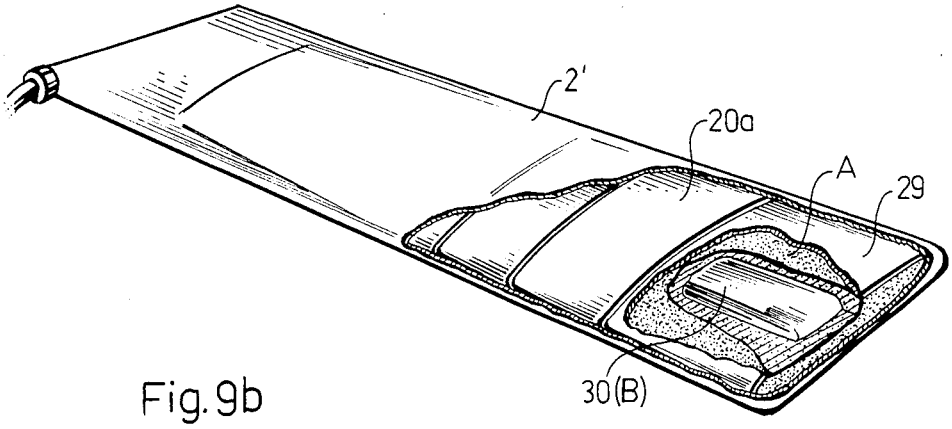
FIG. 6 is a perspective view, with partly cut away portions, of another embodiment of the package according to the invention.

FIG. 6 shows an alternative embodiment of the container 2' and the storage compartments for the components. In this case, the package 2' is provided with an open pocket 29 at its end, into which a sealed plastic bag 30 containing one component B is inserted, whereupon the pocket 29 is also filled with the other component (A). Thereafter, the outer end of the package 2' may be sealed, if necessary. By means of a roller device according to FIG. 1 or 5, the components A and B can be mixed and fed forward in a corresponding way as described above.

Figure 7A:
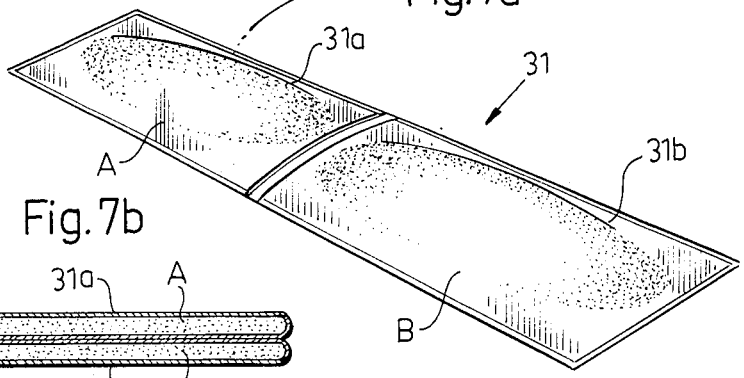
FIG. 7*a* is a perspective view of a device with two storage compartments to be inserted into a flexible package according to the invention.
Figure 7B:
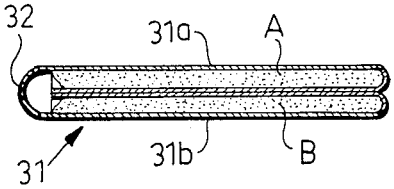
FIG. 7*b* shows a longitudinal section through a device according to FIG. 7*a* in folded position.

Instead of a sealed plastic bag 30 according to FIG. 6, a storage bag 31 as shown in FIG. 7*b* can be inserted into the pocket 29 in the package 2 according to FIG. 6. This storage bag 31 is provided with two storage compartments 31*a*, 31*b* for the components A and B, respectively, and can be folded into the position shown in FIG. 7*b* before being inserted into the pocket 29. While being influenced by the roller 3, the storage bag 31 will break in the region 32 (FIG. 7*b*) when a sufficiently high internal pressure has been achieved, whereupon the components A and B will flow into the first pocket 20*a*. Thereafter, the forward feeding and the mutual mixing of the components takes place in the same way as described above.

Figure 8A:
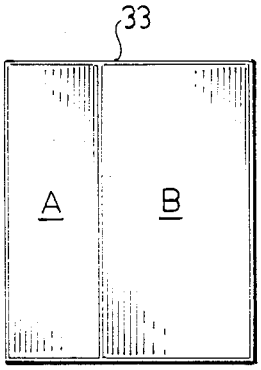
FIGS. 8*a* to 8*c* are top plan views of alternative devices with storage compartments.
Figure 8B:
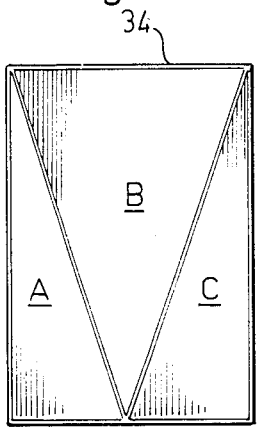
Figure 8C:
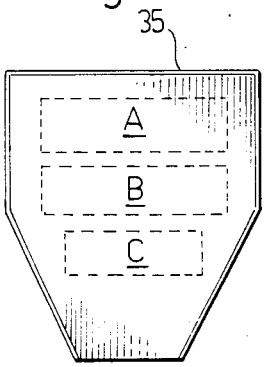

FIGS. 8*a*, 8*b* and 8*c* show different alternative embodiments of the storage bags 33,34 and 35, respectively, with separate compartments for two or three different components A, B and A, B, C, respectively. Such storage bags can be inserted into the open pocket 29 of the package 2 according to FIG. 6.

Figure 9B:
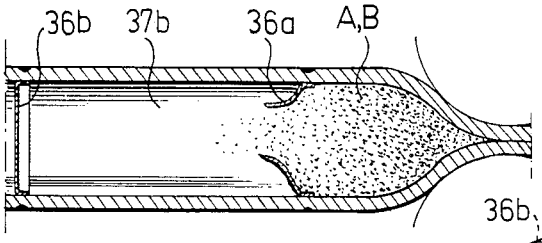
FIG. 9*b* shows a portion of a package according to FIG. 9*a* in longitudinal section.
Figure 9A:
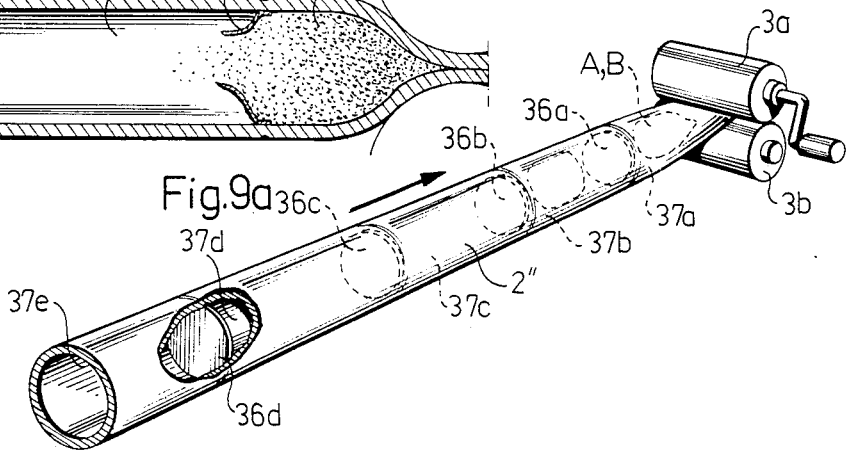
FIG. 9*a* is a perspective view of a third embodiment of a package according to the invention.

A third embodiment of the package 2'' according to the invention, the package in this case being made of a tubular hose 2'' of rubber or thermoplastic material. A number of transverse partitions 36*a*,36*b*,36*c*,36*d* are inserted into the hose 2'', so that they sealingly delimit a series of compartments. When the hose is inserted between a pair of rollers 3*a*,3*b*, the component mixture A,B will be displaced so as to sequentially break the respective partition, so that the component mixture A,B each time flows explosively into the adjacent compartment. This is illustrated in FIG. 9*b*.

Figure 10:
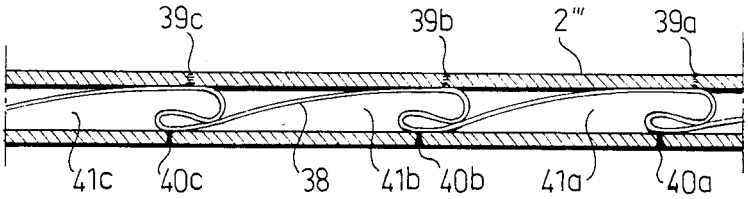
FIG. 10 shows in longitudinal section a fourth embodiment of the package according to the invention.

FIG. 10 shows another alternative of the package 2''' according to the invention. As in the previous example, the external container consists of a tubular hose, but the series of compartments is formed by a foil strip 38 inserted into the hose, the strip being laid with overlapping loops and fixed to the hose wall by means of upper, weaker welds 39*a* to 39*c* and lower, stronger welds 40*a* to 40*c*, so that closely separated compartments 41*a* to 41*c* are formed.

Figure 11:
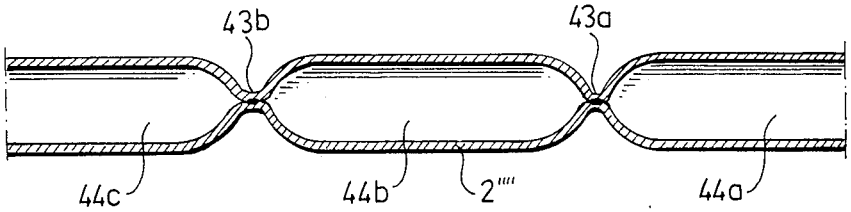
FIG. 11 shows in longitudinal section a fifth embodiment of the package according to the invention.

FIG. 11 shows a fifth embodiment of the package 2'''' according to the invention. As in the previous case, the container consists of a tubular hose, which by means of rather weak welds 43a,43b is provided with tight constrictions forming separate compartments 44a to 44c.

Figure 12:
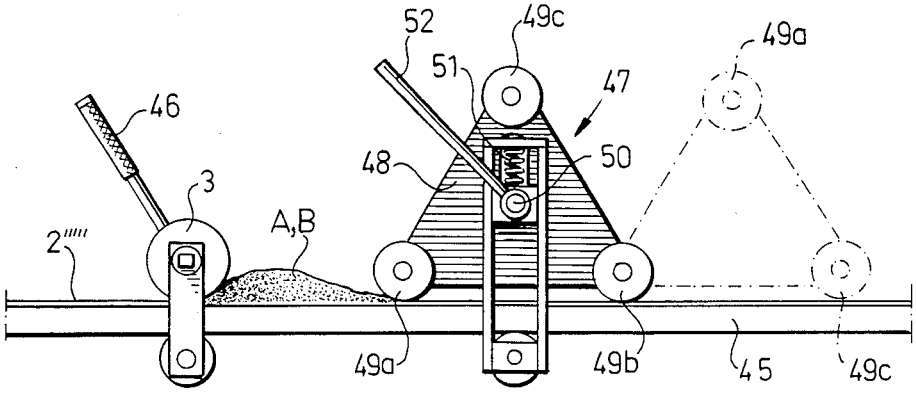
FIG. 12 is a side view of an alternative squeezing device for cooperation with a flexible package.

To achieve the desired, explosive exhaust flow from one compartment to the next, it is not essential that the package be provided from the outset with separated chambers. Thus, FIG. 12 shows an alternative squeezing device for cooperation with a flexible, longitudinal package 2'''''', which may be flat or hose-like and which has no inside partitions or constrictions.

On a table or plate 45 there is arranged, on the one hand, a rollable, resilient roller 3 having an actuating handle 46 and on the other hand, a squeezing device 47 consisting of holding body 48 of triangular cross-section and squeezing rollers 49a,49b,49c disposed at the corner edges thereof. The holding body 48 is centrally rotatably connected to a shaft 50, which on each side of the table or plate 45 is kept pressed down against the table or plate by means of a pressure spring 51. By means of a handle 52, the holding body 48 with the squeezing rollers 49a to 49c are turned over to the dash-dotted position, wherein the squeezing rollers 49b stay in contact with the package 2'''''' on the table or plate 45.

The device operates in the following manner: Suppose that the squeezing device 47 is in the position shown in solid lines FIG. 12 and that two (or more) liquid or paste-like components A and B are disposed inside the packages 2'''''' between the rollers 3 and the squeezing device 47. By means of the handle 46, the squeezing roller 3 is rolled towards the squeezing device 47, causing an increased pressure in the space, in which the components A,B are located. The handle 46 is connected to the roller 3 by means of a momentum coupling, thereby causing a predetermined squeezing pressure and, thus, a predetermined internal pressure in the package.

Thereafter, the handle 52 of the squeezing device 47 is actuated, so that the engagement of the squeezing roller 49a onto the package suddenly ceases, and the component mixture A,B suddenly flows into the now free space between the roller 3 and the squeezing roller 49b. Provided that the handle is turned quickly, the component mixture A,B will flow explosively in a way corresponding to what has been described above, so that the components are mixed intimately and effectively with each other. It is obvious that the roller 3 can be moved forward until an increased internal pressure is again reached, whereupon the squeezing device 47 is turned a further step forward.

Figure 13:
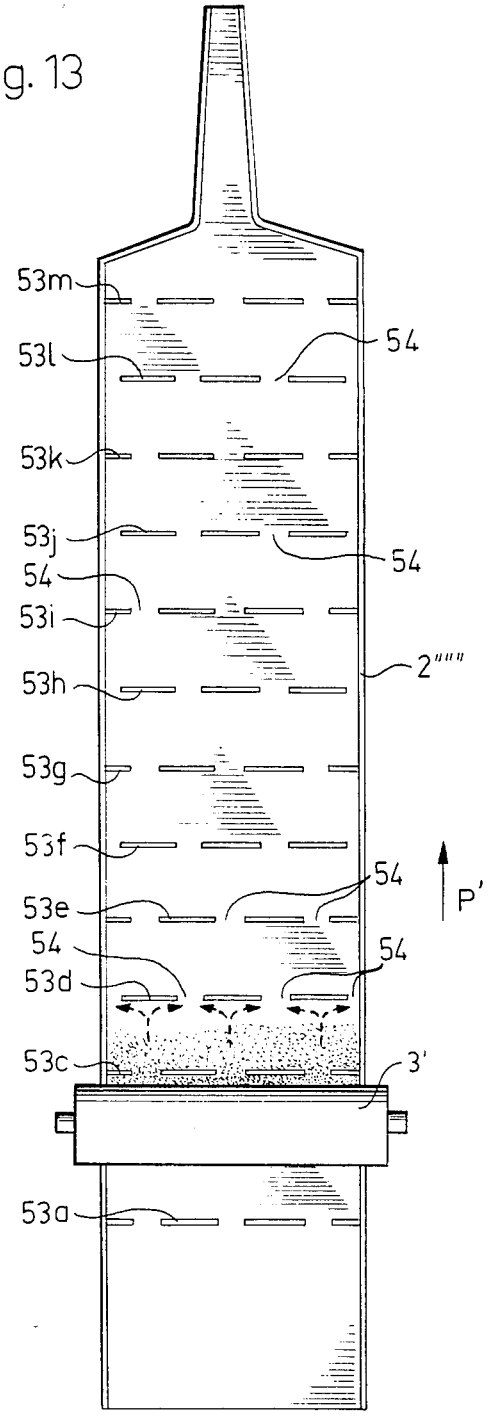
FIG. 13 shows in a top plan view a seventh embodiment of the package according to the invention with an associated squeezing roller.

According to a seventh embodiment of the package 2'''''', shown in FIG. 13, the compartments succeeding one another need not be closely separated. Thus, a plastic foil bag which is provided with storage compartments (not shown) and which may be inserted into a squeezing roller device, e.g., according to FIG. 1 or FIG. 5, comprises a number of transverse arranged partitions 53a to 53m. Each such partition is provided with a number of mutually separated passages 54. When the squeezing roller 3' is displaced relative to the package in the direction of the arrow P', the components are pressed forward in the respective compartment. As shown in FIG. 13, it is possible for the component mixture at a given time occupy two or more compartments. When the squeezing roller 3' approaches a partition, e.g., 53c in FIG. 13, the component mixture is forced to flow through the passages 54 with a dramatically increased flow velocity because, in the region upstream of the respective wall portion, the mass must be strongly deflected sideways, as indicated by the arrows S in the succeeding compartment. The sideways deflection causes is the final stage a strong increase of the internal pressure and an explosive exhaust of the component mixture via the passages 54 to the adjacent compartment, resulting in an effective mixing effect. This effect will be further improved if the passages 54 of two successive partitions are laterally offset so as to enhance the transverse deflection.

The mixing effect is also enhanced by the fact that the first package 2'''''' has been evacuated in connection with the manufacture and loading of the components into the compartments (not shown). This causes the forward feeding of the component mixture to take place against the pressure of the ambient air, resulting in a higher internal pressure.

It will be understood that the essential feature of the invention is that two or more liquid or paste-like components, especially components which are barely miscible with each other, are fed forward inside a flexible package while being exposed to an external squeezing action, so that an explosive discharge takes place in one or, particularly, in several steps. Such an explosive discharge can be achieved already in the first step, wherein the components will thus flow directly from the respective storage compartment to an adjacent common compartment of the package.

We claim:

1. A method for intimately mixing at least two mutually barely miscible or paste-like components (A,B) with each other, wherein, initially, the different components are kept in separate storage compartments (16,17; 29,30; 31a,b;33;34;35) in a flexible package (2), said method comprising the steps of (a) applying external pressure to the package and causing the components to flow into a common compartment (20a–d; 37a–37c; 41a–c; 44a–c) while being mixed together, (b) applying an external pressure to the common compartment and building up an increased internal pressure in the common compartment; and (c) causing the components (A,B) to flow explosively together into an adjacent compartment while being intimately mixed with each other.

2. A method according to claim 1, wherein said step of causing the components to flow explosively together said is achieved by suddenly eliminating a demarcation (20a; 36a; 40b,43a) between said common compartment (20b,37b,41b;44b) and said adjacent compartment.

3. A method according to claim 2, wherein said eliminating of a demarcation is caused by building up the internal pressure until a partition (20,36;40b) or constriction (43a) is caused to break under the influence of said increased internal pressure.

4. A method according to claim 1, wherein said step of causing the components to explosively flow together is achieved by squeezing the components while pressing forward against a transverse partition (53a,53b, . . .) provided with separated passages (54), so that the flow increases dramatically in the final stage when the squeezing force approaches the transversal partition (FIG. 13).

5. A method according to any one of claims 2, 3 or 4, wherein the step of causing the components to flow explosively into an adjacent compartment is repeated at least once, so that the mixture flows explosively into a third or subsequent common compartment.

6. A method according to claim 1, wherein the step of causing the components to flow into a common compartment includes causing the components to explosively flow into the common compartment as brought about by the application of external pressure so as to effect an intimate mixing action.

7. A method according to claim 1, wherein the step of applying external pressure includes squeezing the package (2) between a roller (3) and a counter-acting surface (1; 3*b*; 45).

8. A device for intimately mixing at least two mutually barely miscible or paste-like components with each other, comprising a flexible package (2) having separated storage compartments (16,17; 29,30,31*a*,*b*; 33;34;35) for the different components (A,B) and means for applying an external pressure on the package to cause the components to flow into a common compartment, wherein said means (3;3*a*;3;47) achieve, by a squeezing action, increased internal pressure in said common compartment in the package to cause the components to flow explosively into an adjacent compartment while being intimately mixed with each other.

9. A device according to claim 8, wherein said means (3,3*a*;3,47) are adapted to bring about a sudden elimination of a demarcation between the adjacent compartments.

10. A device according to claim 9, wherein at least two successive compartments are separated by a partition (20*a*; 36*a*; 40*b*) or a constriction (43*a*) which is dimensioned to break only upon the building up of internal pressure in the first compartment by the action of said means.

11. A device according to claim 10, wherein said successive compartments are formed by a number of open foil pockets (20*a*–*d*), which are inserted partly into one another and are enclosed in an external flexible container (2).

12. A device according to claim 8, wherein said means comprises a squeezing roller (3') adapted to displace the squeezing action in a direction towards a transverse partition (53*a*,53*b*, . . . ) of the package (2''''''), said partition being provided with separated flow passages (54); so that the flow increases dramatically in the final stage when the squeezing roller (3') approaches the partition (53*a*,53*b*, . . . ).

13. A device according to claim 12, wherein the package (2'''''') has several successive compartments separated from each other by partitions (52*a*, 53*b*, . . . ) and the flow passages (54) of successive partitions (53*a*, 53*b*, . . . ) are transversely displaced.

* * * * *